US007874835B2

(12) United States Patent
Schwank et al.

(10) Patent No.: US 7,874,835 B2
(45) Date of Patent: Jan. 25, 2011

(54) RADIANT TUBE HEATER AND BURNER ASSEMBLY FOR USE THEREIN

(75) Inventors: Bernd Schwank, Cologne (DE); Samer Hassan, Mississauga (CA); Fariborz Farshad, Toronto (CA)

(73) Assignee: Schwank Ltd., Mississauga, Ontario (CA)

( * ) Notice: Subject to any disclaimer, the term of this patent is extended or adjusted under 35 U.S.C. 154(b) by 293 days.

(21) Appl. No.: 12/056,543

(22) Filed: Mar. 27, 2008

(65) Prior Publication Data

US 2009/0241942 A1 Oct. 1, 2009

(51) Int. Cl.
*F23D 14/62* (2006.01)

(52) U.S. Cl. ..... 431/354; 431/10; 431/351; 431/353; 126/91 A; 126/91 R; 126/104 A; 432/175; 432/189

(58) Field of Classification Search ..... 431/354, 431/353, 351, 9, 12, 116, 350, 355, 183, 431/7, 10, 187, 169, 186, 181, 328; 126/91 A, 126/91 R, 104 A; 237/12, 70; 432/175, 189, 432/194, 120, 159
See application file for complete search history.

(56) References Cited

U.S. PATENT DOCUMENTS

| | | | | |
|---|---|---|---|---|
| 2,119,952 | A | 6/1938 | Engels | |
| 2,964,103 | A | 12/1960 | Ryder | |
| 3,042,105 | A | 7/1962 | Bitterlich | |
| 3,195,609 | A * | 7/1965 | Nesbitt et al. | 431/9 |
| 3,227,202 | A | 1/1966 | Morgan | |
| 3,229,748 | A * | 1/1966 | Spielman | 431/352 |
| 3,413,069 | A | 11/1968 | Walsh | |
| 3,975,141 | A * | 8/1976 | Sweet | 431/352 |
| 4,263,780 | A * | 4/1981 | Stettler | 60/39.23 |
| 4,561,841 | A * | 12/1985 | Korenyi | 431/265 |
| 4,705,022 | A | 11/1987 | Collier | |
| 4,752,213 | A * | 6/1988 | Grochowski et al. | 431/328 |
| 4,762,487 | A | 8/1988 | Zappa | |
| 4,766,877 | A | 8/1988 | Jensen | |
| 5,224,542 | A | 7/1993 | Hemsath | |
| 5,361,750 | A * | 11/1994 | Seel et al. | 126/91 A |
| 5,429,112 | A | 7/1995 | Rozzi | |
| 6,482,000 | B2 | 11/2002 | Sestrap et al. | |
| 6,786,422 | B1 * | 9/2004 | Wortman et al. | 237/70 |

OTHER PUBLICATIONS

U.S. Appl. No. 11/831,130, Virag et al.

* cited by examiner

*Primary Examiner*—Carl D Price
*Assistant Examiner*—Avinash Savani
(74) *Attorney, Agent, or Firm*—Gifford, Krass, Sprinkle, Anderson & Citkowski, P.C.

(57) ABSTRACT

A burner assembly for a radiant tube heater having an air duct portion for passage of combustion air to a radiant tube portion includes a mixing cup for mixing combustible gas and air and delivering the mixture to the tube. This cup has an inlet portion and a larger cylindrical outlet portion. Air inlet holes are formed in an upstream end wall of the outlet portion and air ports are formed in a peripheral wall of the inlet portion. An air diverter mounted at an upstream end of the inlet portion has a set of blade which divert a portion of the air through the ports for initial mixing with the gas while a second portion of the air flows through the inlet holes providing additional primary air for mixing. An airflow restricting plate can be mounted on the cup so as to extend circumferentially around the cup.

15 Claims, 9 Drawing Sheets

RADIANT TUBE HEATER AND BURNER ASSEMBLY FOR USE THEREIN

BACKGROUND OF THE INVENTION

This invention relates to radiant tube heaters and burner and heating assemblies for use therewith.

A known type of radiant heater for heating the interior of buildings and other areas is a so-called radiant tube heater which has a relatively long, radiant tube made of a suitable metal and adapted to enclose an elongate flame projected from a burner head. This heater can include a combustion air blower, a burner nozzle connected to a combustible gas supply, and a burner head connected to the nozzle. The nozzle and head are positioned in a combustion air duct section forming a passage for combustion air and the outlet of the blower is attached to an inlet end of this duct section so that the blower is able to direct combustion air through the duct section. The burner head which in an exemplary embodiment is arranged centrally in the air duct section, creates an annular passageway between itself and the air duct section. Combustible gas, such as natural gas, can be delivered to the radiant heater through a gas valve governor which is connected by a line to the burner nozzle. Combustion air enters the burner head through vents or ports in the side wall of an inlet portion of the head and then mixes with the fuel, thereby producing a gas/air mixture which can exit through a perforated ceramic tile mounted in a downstream end of the head. The mixture can be ignited by a suitable electrode resulting in a long laminer flame extending down the radiant tube.

One form of radiant tube heater is described and illustrated in co-pending U.S. patent application Ser. No. 11/831,130 filed Jul. 31, 2007 and the disclosure and drawings of this co-pending application are incorporated herein by reference. This radiant tube heater in addition to including the aforementioned features, employs a tubular arrangement that includes an air duct portion forming a combustion air passage and a radiant tube portion which is heated. An airflow restricting plate is mounted in the air duct portion and extends circumferentially around the burner head. This plate can increase the flow of pressurized combustion air through the openings formed in the inlet portion of the burner head while also allowing a substantial portion of the combustion air to flow downstream between the wider outlet portion of the head and the air duct portion to provide secondary air for combustion.

The blower for the aforementioned radiant tube heater has a blower housing with a relatively straight, outlet section. Mounted on an outer wall of this outlet section are two pressure sensors in the form of pitot tubes of standard construction. These sensors are connected to differential pressure switches to ensure that the blower is in operation and is providing sufficient combustion air to the burner head when the mixture of combustion air and gas is ignited. The heater is constructed so as not to operate unless sufficient combustion air is being provided to the heater.

There is disclosed herein an air diverter for a radiant tube heater of the above-mentioned type which is mounted at or near an upstream end of the burner head which, in addition to imparting a swirling motion to the incoming combustion air, acts to direct more of this combustion air through ports formed in an inlet portion of the burner head. Thus, more primary air that enters through these ports is able to mix with the combustion gas over a greater distance prior to the mixture of air and gas exiting from the burner head.

SUMMARY OF THE INVENTION

According to one embodiment of the invention, a burner assembly for a radiant tube heater having an air duct portion forming a passage for combustion air from a blower and a radiant tube portion extending downstream from the air duct portion in relation to the flow of the combustion air includes a mixing cup device for mixing combustible gas and a portion of the combustion air and for delivering the resulting mixture to the radiant tube portion for burning. This cup device is adapted for mounting in the air duct portion and has an inlet portion and a larger, substantially cylindrical outlet portion having a diameter greater than a corresponding dimension of the inlet portion. Air inlet holes are formed in an upstream end wall of the outlet portion and air ports are formed in a peripheral wall of the inlet portion. A gas nozzle is provided in the inlet portion and connectable to a combustible gas supply line. An air diverter is adapted for mounting adjacent an upstream end of the inlet portion and has a plurality of blades distributed about a perimeter thereof. During use of the burner assembly, the air diverter directs a portion of the combustion air through the ports to provide primary air for initial mixing with the combustible gas and impart a swirling motion to the combustion air. The air diverter also allows a second portion of the combustion air to flow through the inlet holes to provide additional primary air for mixing with the combustible gas.

In an exemplary version of this burner assembly, an annual air flow restricting plate is mounted on the mixing cup device and extends circumferentially around the mixing cup device. This plate has an array of holes formed therein so that, during use of the burner assembly, the restricting plate substantially spans an annular passage for secondary combustion air formed between the outlet portion and the air duct portion.

According to another embodiment of the invention, a heating assembly is provided for a radiant tube heater having a radiant burner tube with an upstream end. The heating assembly includes a mixing cup assembly adapted for mounting centrally within the burner tube and adapted for mixing primary air and combustible gas and for delivering the resulting mixture into the burner tube. The cup assembly has an inlet portion and a substantially cylindrical outlet portion having a diameter greater than a corresponding dimension of the inlet portion. A series of air inlet holes are formed in an upstream end wall of the outlet portion for introduction of the primary air directly into the outlet portion and ports are formed in and around the inlet portion for introduction of the primary air into the inlet portion for initial mixing with the combustible gas. A gas line is provided to introduce the combustible gas into the mixing cup assembly, this gas line having one end connected to the mixing cup assembly and an opposite upstream end. A gas valve system including a gas valve unit has an outlet connected to the upstream end of the gas line. The gas valve system regulates flow of the combustible gas to the mixing cup assembly during use of the heating assembly. A blower for providing air for combustion to the radiant tube heater includes a blower outlet section adapted for connection to the upstream end of the burner tube. This air for combustion includes both primary air and secondary air. An air diverter is adapted for mounting at or near an upstream end of the mixing cup assembly and has a plurality of diverter blades distributed circumferentially around the upstream end of the mixing cup assembly. During use of the heating assembly, the diverter blades direct a portion of the combustion air from the blower through the ports to provide primary air and impart a swirling motion to the combustion air from the blower. A further portion of the combustion air enters the outlet portion of the mixing cup assembly through the air inlet holes to provide a further amount of primary air for mixing with the combustible gas. A remaining amount of the combustion air flows between the outlet portion and the burner tube to provide the secondary air for combustion.

In an exemplary form of this heating assembly, the inlet portion of the mixing cup assembly has a cylindrical end section of reduced diameter forming an upstream facing shoulder and the air diverter is fixedly mounted on this end section adjacent the shoulder.

According to a further embodiment of the invention, a radiant tube heater apparatus includes an elongate tubular arrangement having an air duct portion forming a passage for combustion air, including primary air and secondary air and a radiant tube portion which is heated by and surrounds the laminar flame during use of the heater apparatus and which extends downstream of the air duct portion in relation to the flow of combustion air in the passage. The air duct portion has an inlet at one end for receiving the combustion air. There is also a blower for providing combustion air to the inlet of the air duct portion, this blower including a blower casing with an outlet section adapted for connection to the air duct portion at the inlet. A burner assembly is mountable in the air duct portion, this burner assembly including a mixing cup assembly for mixing combustible gas and the primary air and for delivering the resulting mixture to the radiant tube portion for burning. The cup assembly has an inlet portion and a substantially cylindrical outlet portion having a diameter greater than a corresponding dimension of the inlet portion. A series of air inlet holes are formed around an annular upstream end wall of the outlet portion and the inlet portion has ports formed in a peripheral wall thereof. A gas line is provided for conducting the combustible gas to the inlet portion of the burner assembly. An air diverter is provided for mounting within the air duct portion adjacent an upstream end of the inlet portion of the cup assembly. The air diverter has a plurality of blades distributed about a perimeter thereof. An air flow restricting device is mounted on and extends around the cup assembly, this restricting device being adapted to restrict flow of secondary air between the outlet portion and an inner wall of the air duct portion during use of the tube heater apparatus. During use of the tube heater apparatus, the air diverter directs a portion of the combustion air through the ports to provide the primary air for initial mixing with the combustible gas. A further portion of the combustion air enters the outlet portion through the air inlet holes to provide an additional amount of the primary air for mixing with the combustible gas. The remaining amount of the combustion air flows between the outlet portion and a surrounding inner wall of the air duct portion to provide the secondary air for combustion.

In an exemplary version of this tube heater, the air diverter is a ring member having a plurality of diverter blades distributed about its circumference and this ring member is fixedly mountable on the inlet portion of the mixing cup assembly.

Further features and advantages will become apparent from the following detailed description of an exemplary embodiment of the invention taken in conjunction with the accompanying drawings.

DETAILED DESCRIPTION OF EXEMPLARY EMBODIMENTS

In the detailed description which follows, exemplary embodiments are described, particularly with reference to the figures appended thereto. However, the particularly described embodiments are merely illustrative of radiant tube heaters and pitot tube assemblies for sensing pressure constructed according to the present disclosure.

Figure 1:
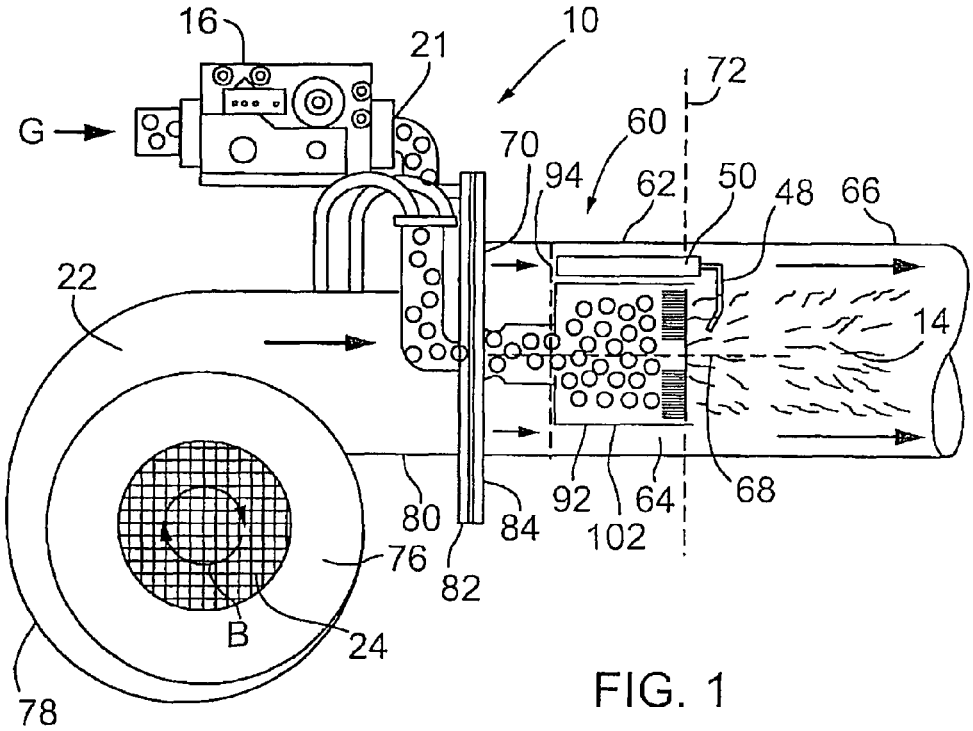
FIG. 1 is a schematic, cross-sectional view of a radiant tube heater in use, this view showing an elongate laminar flame extending from a burner head, a major portion of the radiant tube being omitted along with its reflector/shield for illustration purposes.
Figure 2:
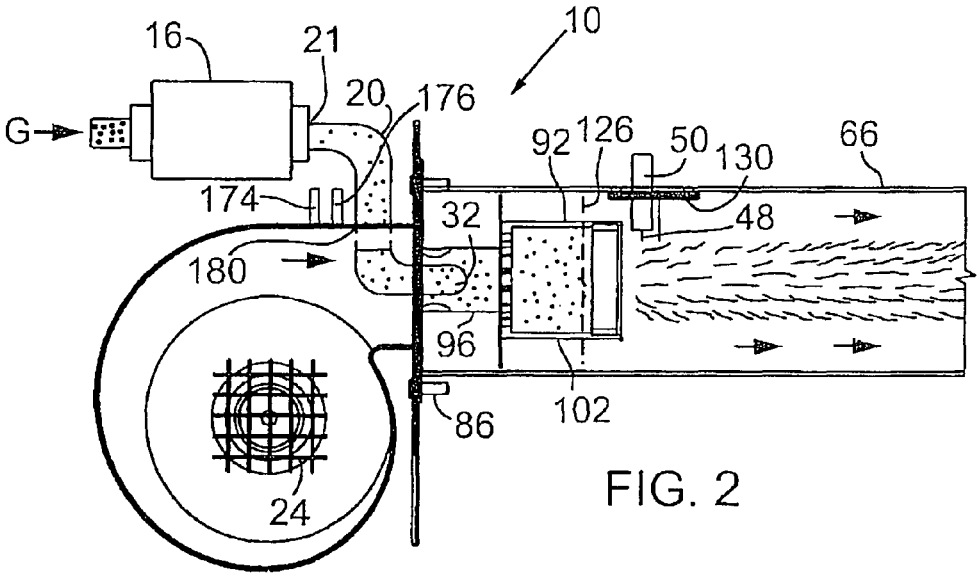
FIG. 2 is another schematic cross-sectional view similar to FIG. 1 showing another embodiment of a radiant tube heater.

Referring now to the drawings, wherein like reference numerals identify similar structural elements of the heating units, FIGS. 1 and 2 illustrated schematically embodiments of radiant tube heaters constructed in accordance with co-pending U.S. patent application Ser. No. 11/831,130 filed Jul. 31, 2007. The radiant tube heater includes an elongate heating tube 66, only an upstream portion of which is shown for ease of illustration. This cylindrical tube can comprise several sections arranged end to end. The length of a heating tube can extend ten feet or more and the tube encloses an elongate flame 14 during use. The tube is heated by the flame and combustion gases to emit infrared radiant heat. Preferably the tube is located within or under a downwardly opening, trough-shaped reflector/shield such as that shown in FIG. 15. This reflector/shield of the heater receives upwardly-directed radiant energy from the tube and reflects or radiates this energy downwardly to an area or region requiring heating. Also shown is a gas valve governor, also referred to herein as a gas valve unit 16 for the heater which is adapted for connection to a first end 21 of a gas pipe or gas line 20, this line extending to a burner nozzle at 32 and a burner head 92 mounted on the nozzle. The heating assembly in each of FIGS. 1 and 2 includes a blower or blower fan 22 having a side air inlet 24 into which external air is drawn. The blower has an outlet section which extends tangentionally relative to the blower fan and which is connected to the upstream end of the burner tube 66.

The burner head or mixing cup assembly 92 is adapted for mounting within the burner tube 66 and is adapted for mixing primary air and combustible gas and for delivering the resulting mixture into an upstream end section of the burner tube as shown. The burner head is generally annular and has a cylindrical inlet portion 96 and a wider cylindrical outlet portion 102 integrally connected to the inlet portion and located at the downstream end of the inlet portion. The aforementioned nozzle 32 extends into the inlet portion and can be connected thereto by a thread connection, including internal threads 108 formed in an upstream end section of the inlet portion 96 (see FIGS. 3 and 4).

It will be understood that the heater is provided with natural gas or LPG gas indicated by the arrow G taken from a suitable source and delivered through the gas valve governor 16 and the pipe or line 20 to the burner nozzle. A portion of the combustion air enters through vents or ports distributed about the periphery of the inlet portion 96 to provide primary air. In the burner head, the gas intermingles with the primary air to produce a gas/air mixture that exits the burner head through a perforated ceramic tile 46 located at the downstream end of the outlet portion 102. The exiting mixture is ignited by an ionization electrode 48 of an igniter 50 so as to produce a long laminar flame that extends substantially the length of the tube 66. The preferred material for the radiant tube is stainless steel or aluminized steel, at least for an upstream section thereof that surrounds the flame and the burner head. The remaining downstream section can be cold rolled steel. A typical dimension for such a heating tube is four inches in diameter and the tube sections can be provided in standard lengths of ten feet each which are connected together end-to-end. Typically two to five such radiant tube sections are connected together to form a complete heating tube which can be connected at the downstream end to a suitable exhaust pipe or passage (not shown).

The illustrated heating tube is an elongate tubular arrangement that includes an air duct portion 62 forming a combustion air passage and a radiant tube portion which is the portion actually heated by and surrounding the laminar flame during use of the heater and which extends downstream of the air duct portion in relation to the flow of combustion air in the air passage 64. The air duct section has a central longitudinal axis indicated at 68 in FIG. 1, an inlet end 70 forming an air inlet for receiving combustion air and an opposite end located approximately at the dash line 72 where the air duct portion integrally connects to the radiant tube portion.

Figure 6:
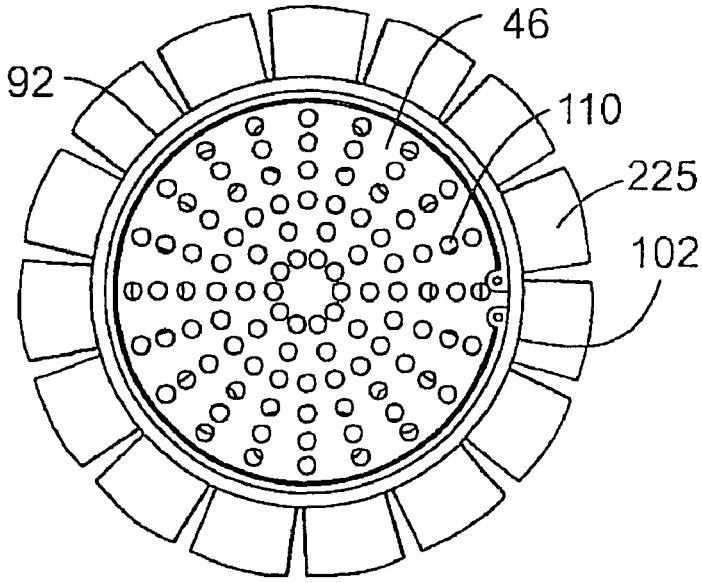
FIG. 6 is a downstream end view of the burner head and air diverter.
Figure 7:
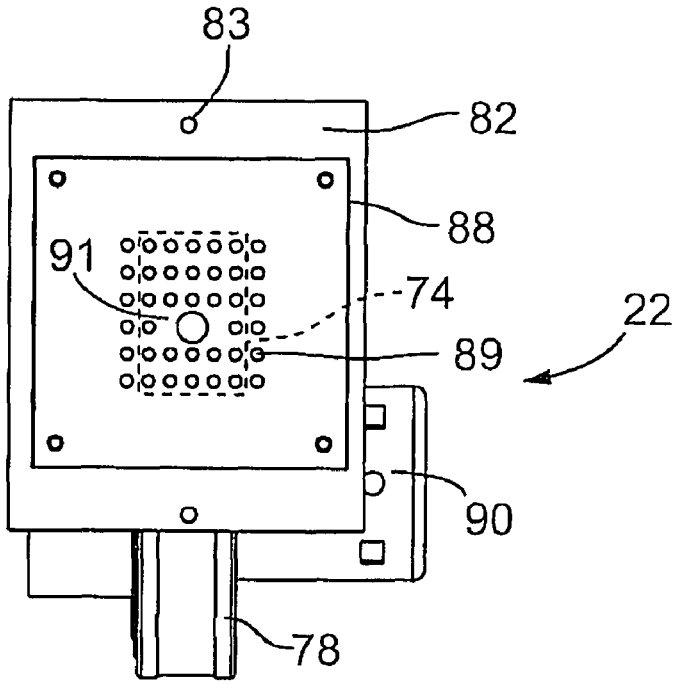
FIG. 7 is an end view of the blower of the radiant tube heater, together with its mounting flange or mounting plate.
Figure 8:
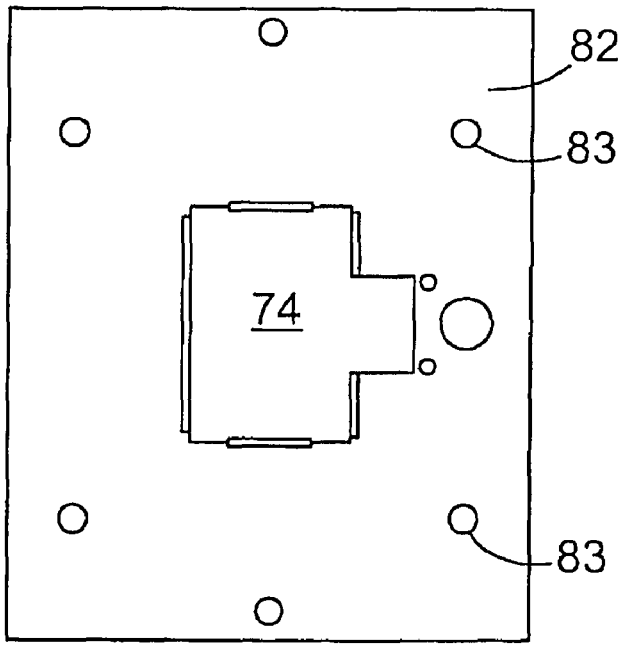
FIG. 8 is a detail view of one form of mounting flange for the blower, this view showing the downstream side.
Figure 10:
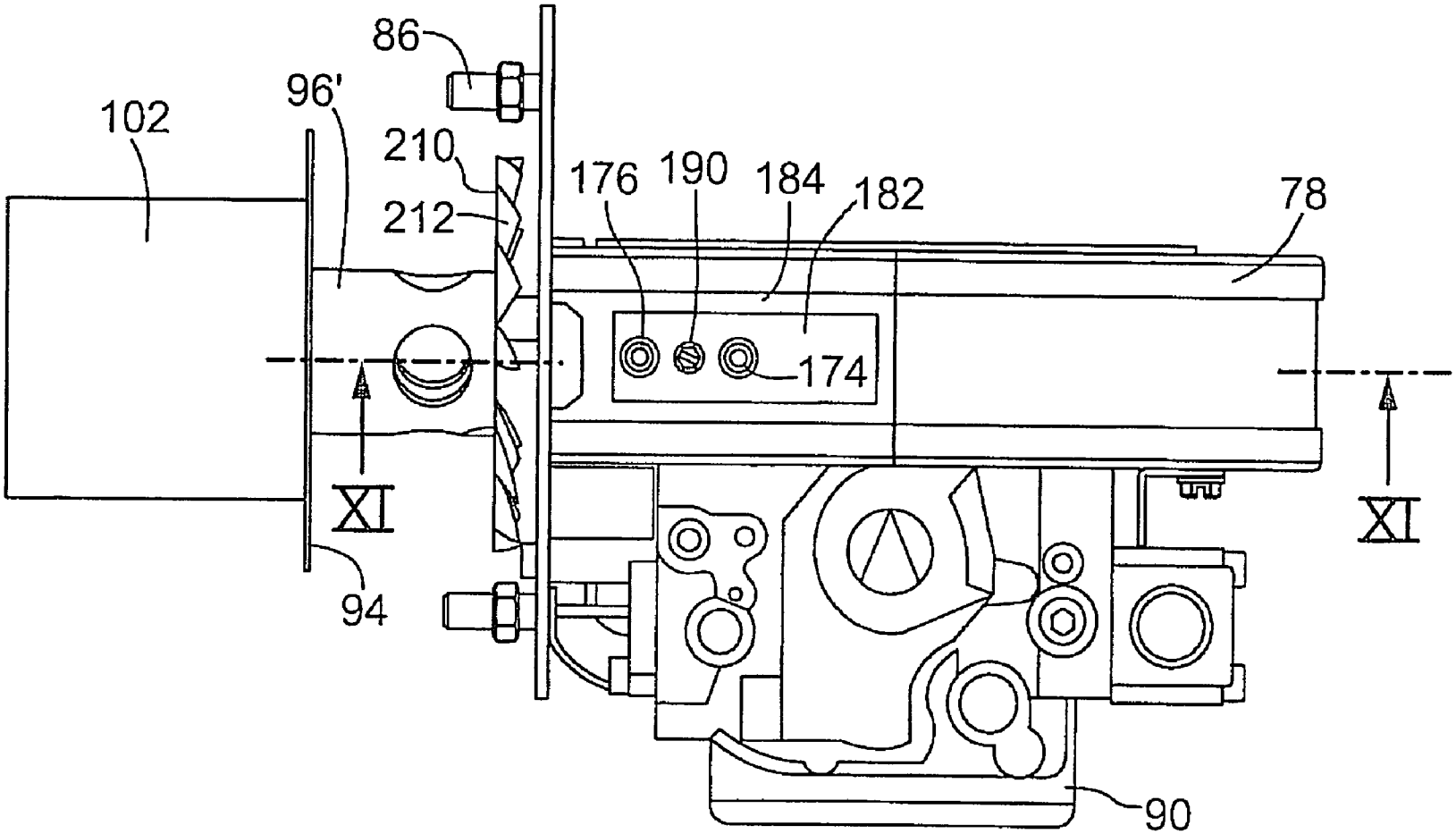
FIG. 10 is a side view of the burner head and the blower of FIG. 9, together with its mounting flange, this view showing the air diverter mounted on the burner head.

The blower 22 has an air outlet 74 which can be rectangular as shown in FIGS. 6 and 7. The blower is able to provide pressurized combustion air to the inlet end of the air duct section and its housing is sealingly connected to this air duct section at the inlet end 70 thereof. The blower can include a blower fan 75 of the squirrel cage type, a radial cross-section of which can be seen in FIG. 10. The direction of rotation of the fan is indicated by the arrows B in FIG. 1. The blower includes a blower casing or housing 78 having an outlet section 80 forming the blower outlet. The blower can include an attachment arrangement for connecting the outlet section 80 to the inlet end of the air duct portion 62. This attachment arrangement can include a rectangular mounting flange 82 that extends around the outlet formed by outlet section 80. The mounting flange 82 is connected by means of bolts 86 to a mounting flange 84 provided at the inlet end of the burner tube. The flange plate 82 shown in FIGS. 7 and 8 has six bolt holes 83 to accommodate six of the connecting bolts 86 but the number of holes can be fewer or more. Nuts (not shown) are threaded onto these bolts in order to connect the two mounting flanges together. An equalizer plate 88 shown in FIG. 7 has an array of air holes 89 formed therein for the passage of combustion air and a central hole 91 for the passage of the gas line. This plate can be mounted between the two mounting flanges 82, 84 and held in place by at least some of the bolts 86. The function of this equalizer plate is to help distribute the combustion air evenly across the height and width of the air duct section 62. The blower can be powered by an electric motor 90 which in one embodiment is a 1/35 hp, 120 V 60 Hz motor.

Figure 3:
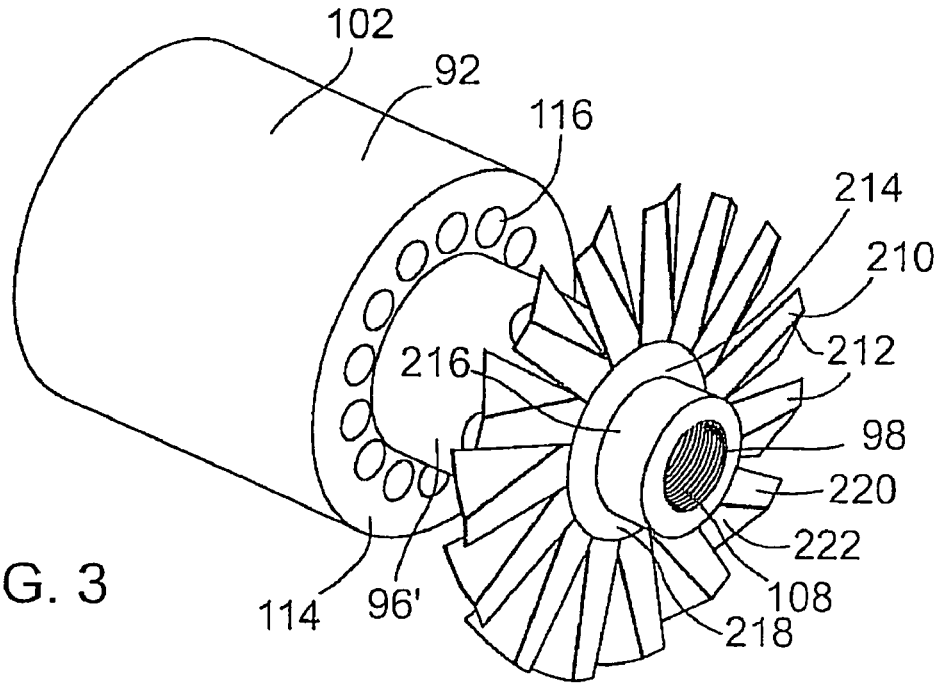
FIG. 3 is a perspective view of the burner head and an air diverter taken from one side and from the upstream end.

FIGS. 3 to 6 illustrate an embodiment of the burner head 92 for the tube heater. As seen in FIG. 3, the inlet portion 96 of the burner head has an upstream end 98 and a downstream end 100. The substantially cylindrical outlet portion 102 is located at the downstream end of the inlet portion. The diameter of the outlet portion is substantially greater than the corresponding transverse dimensions of the inlet portion which can also have a cylindrical exterior. In the illustrated embodiment there are four openings or ports 104 distributed about the periphery of the inlet portion for passage of combustion air into the burner head but there could be fewer or more of these ports. Extending along the longitudinal center line of the inlet portion is an axial passage 106 which is open ended. At the upstream end are the threads 108 used to attach the nozzle 32 which has exterior threads.

The outlet portion 102 is substantially hollow, except for the perforated ceramic tile 46. This tile has an array of small holes distributed in a radial and circumferential pattern over its surface as shown in FIG. 6. These holes allow a mixture of combustion air and gas to flow smoothly and evenly out of the burner head. If desired, the tile can be formed with a cylindrical center hole which in one embodiment has a diameter of 3/8ths inch. This center hole can be desirable for burners with a low firing input rate and can be omitted in burners with a high firing rate. The tile can be held in the end section of the burner head using any one of several possible attachment techniques. For example, the internal wall of the burner head can be formed with a downstream facing shoulder at 112 to engage and locate one side of the tile. Near the downstream end of the outlet portion there can be formed an internal circumferential groove to receive a clip such as a flexible metal C-clip which is sized to fit into the groove and to engage and hold the downstream face of the tile. Alternatively, the tile could be formed with radially extending holes in its circumferential edge to accommodate short threaded fasteners that extends through the wall of the outlet portion into the tile.

Figure 4:
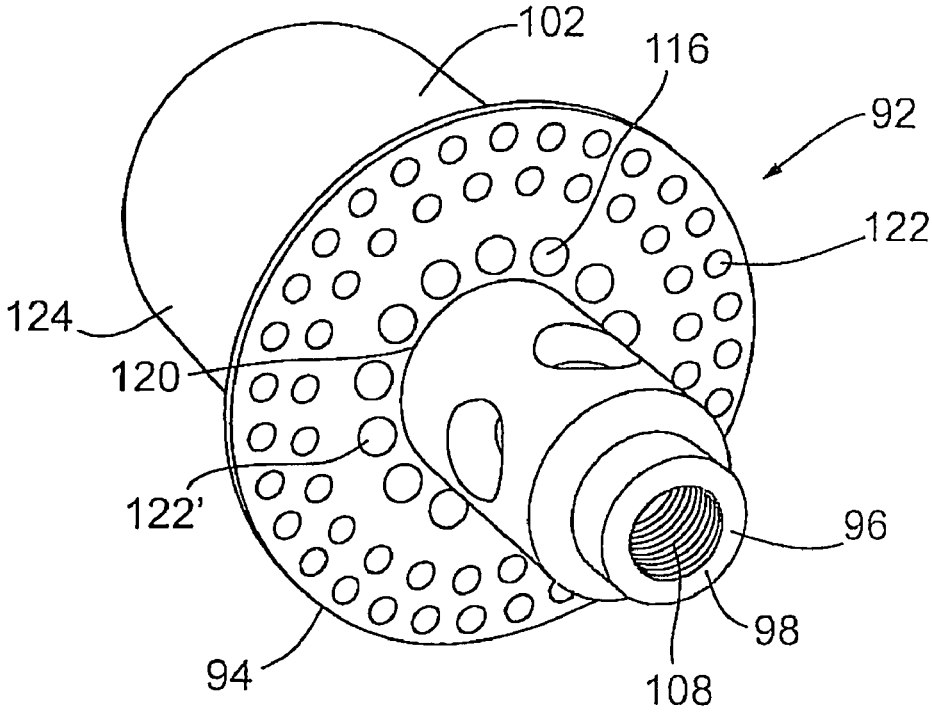
FIG. 4 is a perspective view of the burner head similar to FIG. 3 but showing a restricting plate mounted on the burner head.
Figure 5:
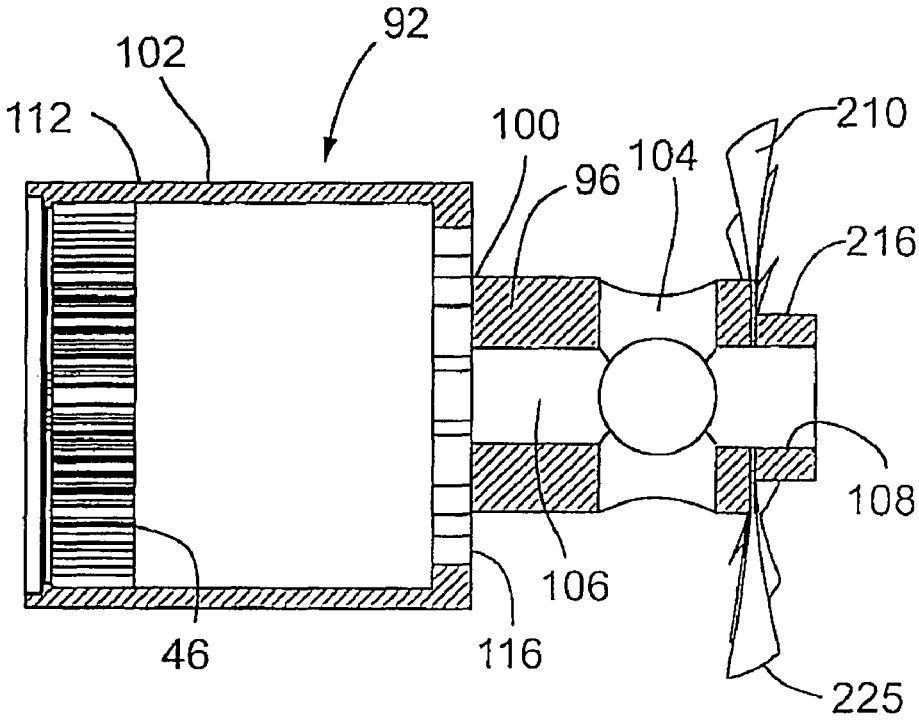
FIG. 5 is an axial cross-section of the burner head of FIG. 3.

The inlet and outlet portions of the burner head are rigidly and integrally connected to each other by an annular disk or wall 114 having a plurality of apertures 116 formed therein as shown in FIG. 3. The arrangement of the wall 114 allows a flat restricting device in the form of plate 94 to be mounted immediately against the wall as shown in FIG. 4. The burner head, as illustrated, can be connected to and supported by the burner nozzle 32 but it can be supported by other means, for example, by securing it to the aforementioned restricting plate 94 and then securing the restricting plate to the air duct section by any suitable fastener means such as mounting brackets and threaded fasteners.

The illustrated restricting plate 94 has a circular perimeter and is an annular plate with a central circular hole at 120 having a diameter slightly greater than the diameter of the inlet portion 96. The plate 94 substantially spans the combustion air passage 64 between the burner head and the air duct section. The plate is formed with an array of air holes 122 distributed over the plate for the passage of combustion air through the plate. The radial innermost holes 122' can be the same in number and size as the apertures 116 formed in the radial wall 114 but it is possible to have fewer holes 122' for some burner applications. By providing fewer holes 122', the plate can be used to restrict air flow into the outlet portion. The holes 122' are aligned with some or all of the apertures 116 so that combustion air can flow through them to provide additional primary air. Two outermost rows of air holes 122 are located beyond the circumferential perimeter of the outlet portion and these holes allow a substantial laminar air flow downstream of the restricting plate around the circumference of the outlet portion 102. Depending on the burner performance requirements, the number of these holes can be increased or decreased and there may be only one outer row of holes beyond the circumference of the outlet portion. The presence of the plate 94 increases the flow of pressurized combustion air through the ports 104 in the inlet portion and this increases the efficiency of the burner by providing turbulent flow in at least a central region of the outlet portion which improves mixing.

It is possible and sometimes desirable to mount the restricting plate 94 downstream from the position shown in FIG. 1 and along the exterior of the outlet portion 102. One such alternative location is indicated by the dash line 126 in FIG. 2. When the restricting plate is in the position shown in FIGS. 1 and 4, it can be secured in this position by a small screw, not shown, extending through a hole in the plate and extending into the annular wall 114. There are various possible ways of securing the restricting plate midway along the outlet portion as shown in FIG. 2, for example, by forming a shoulder on the exterior of the outlet portion against which the restricting plate can rest. The plate can be held against this shoulder by means of a C-clip mounted in a groove formed about the exterior of the outlet portion. The restricting plate can be located at the juncture between the inlet portion and the outlet portion when the heater has a burner with high firing input rates, for example, in the range of 130 and 200 BTU/hour. For lower firing input rates, it can be desirable to move the restricting plate further downstream.

The radiant tube heater can be provided with an igniter 50 for mounting adjacent to the burner assembly for igniting the mixture of combustible gas and air. The igniter has an electrode 48 extending therefrom and projecting in front of the ceramic tile. In the embodiment shown in FIG. 1, the igniter is secured to the side of the burner head. In the embodiment shown in FIG. 2, the igniter is secured to the radiant tube 66 and projects through a hole in the tube. A mounting plate 130 is used to mount the igniter on the wall of the tube so that the igniter projects into the radiant tube portion. The mounting plate can be secured in position by means of screws.

Figure 13:
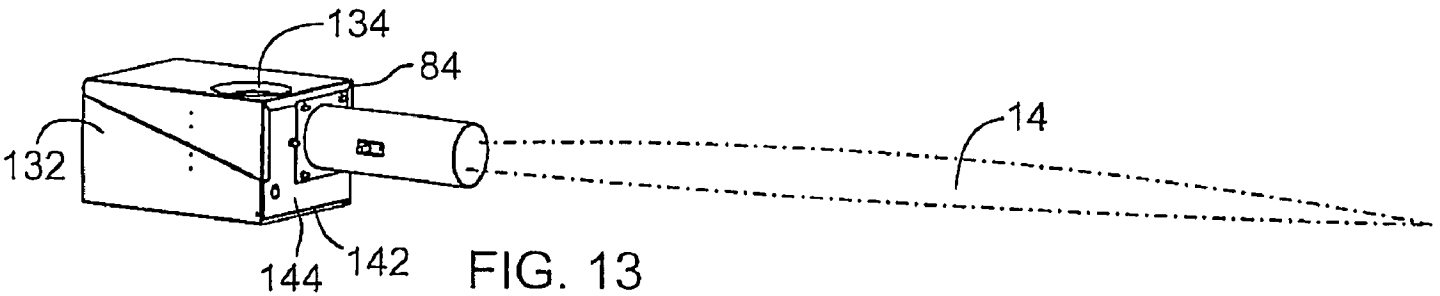
FIG. 13 is a perspective view showing a housing for the blower and its motor and a portion of the radiant tube which extends from one end of this housing.
Figure 14:
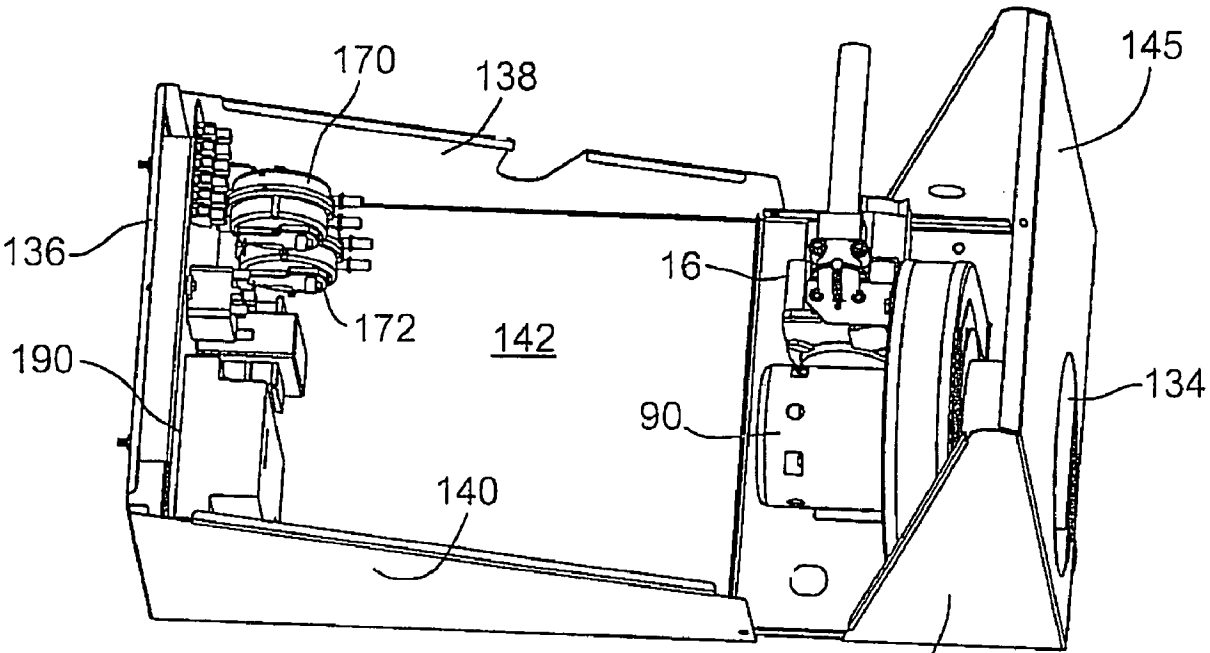
FIG. 14 is a perspective view of the housing of FIG. 13 with the housing being shown in an open position showing the location of the blower and other components of the heater unit.
Figure 15:
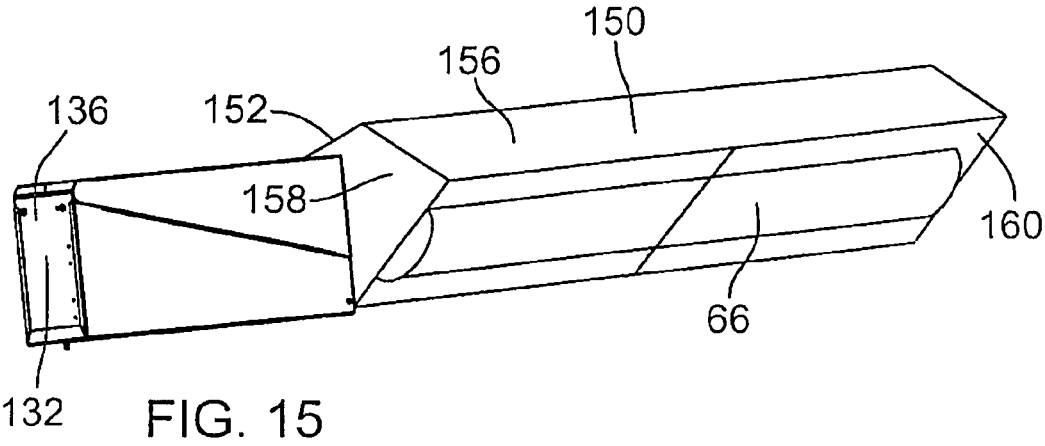
FIG. 15 is a perspective view showing the housing of FIG. 14 in the closed position, a reflector/shield extending from the housing and an elongate radiant tube arranged within the reflector/shield.

Shown in FIGS. 13 to 15 is one form of housing 132 in which can be mounted the blower. This housing is shown in a closed position in FIGS. 13 and 15 and in a swung open position in FIG. 14. The inlet of the blower extends to a side opening 134 in the housing so that exterior air can flow into the blower. The illustrated housing has a rectangular end wall 136 and two opposite side walls 138, 140 connected to the end wall. Also extending between the side walls is a rectangular wall or panel 142. Pivotably attached to the ends of the sidewalls is an end portion 144 and on this end portion can be mounted the blower. The end portion includes a plate 145 in which the opening 134 is formed. Since the blower outlet is normally attached to the burner tube, the end portion 144 is normally fixed in position while the blower cover formed by the walls 136 to 142 is pivotal from the closed position of FIGS. 13 and 15 to an open position.

There can be attached to the fixed end portion 144 a reflector/shield 150 which in use receives upwardly directed radiant energy from the radiant heating tube 66. The shield can have side walls 152, 156 and end walls 158 and 160 and these walls can be formed with polished, reflecting interior surfaces in order to radiate the radiant energy downwardly or towards any desired location. The reflector/shield can be a trough-shaped channel which is open on the downward side.

Also shown mounted to the interior of the housing 132 are two differential pressure switches 170, 172 which can be of standard construction and which together provide differential pressure switch means for controlling the gas valve unit. These switches are provided to ensure the blower is in operation and is providing sufficient combustion air to the burner head when the mixture of combustion air and gas is being ignited. The switches are connected by flexible tubes to two pitot tubes 174, 176 which are part of a pitot tube assembly illustrated separately in FIG. 12. The pitot tubes provide pressure sensors which are part of the control system for the heating assembly. The radiant heater is controlled so that it will not operate unless sufficient combustion air is being provided to the radiant heater by the blower. Also shown in FIG. 14 is an electrical controller 190 used to electronically control the operation of the radiant tube heater. This controller is connected to receive electrical signals from the pressure switches 170, 172.

The pitot tube assembly, in addition to the pitot tubes, includes a mounting plate 182 for attaching the assembly to a wall 184 of the blower casing. As illustrated, the mounting plate is flat and rectangular and is sized to close both a relatively small hole 186 and a separate, larger elongate slot 188 in the wall 184 (see FIG. 9) of the casing during use of the pitot tube assembly. It will be understood that in order to install the pitot tubes, the second pitot tube 176 is manipulated through the hole 186 and, once this is done, the first pitot tube 174 can be inserted through the slot. The mounting plate can then be secured to the wall by means of fastener means such as a single screw 190. Because of the extended length of the mounting plate, the slot is entirely closed off and effectively sealed.

Figure 11:
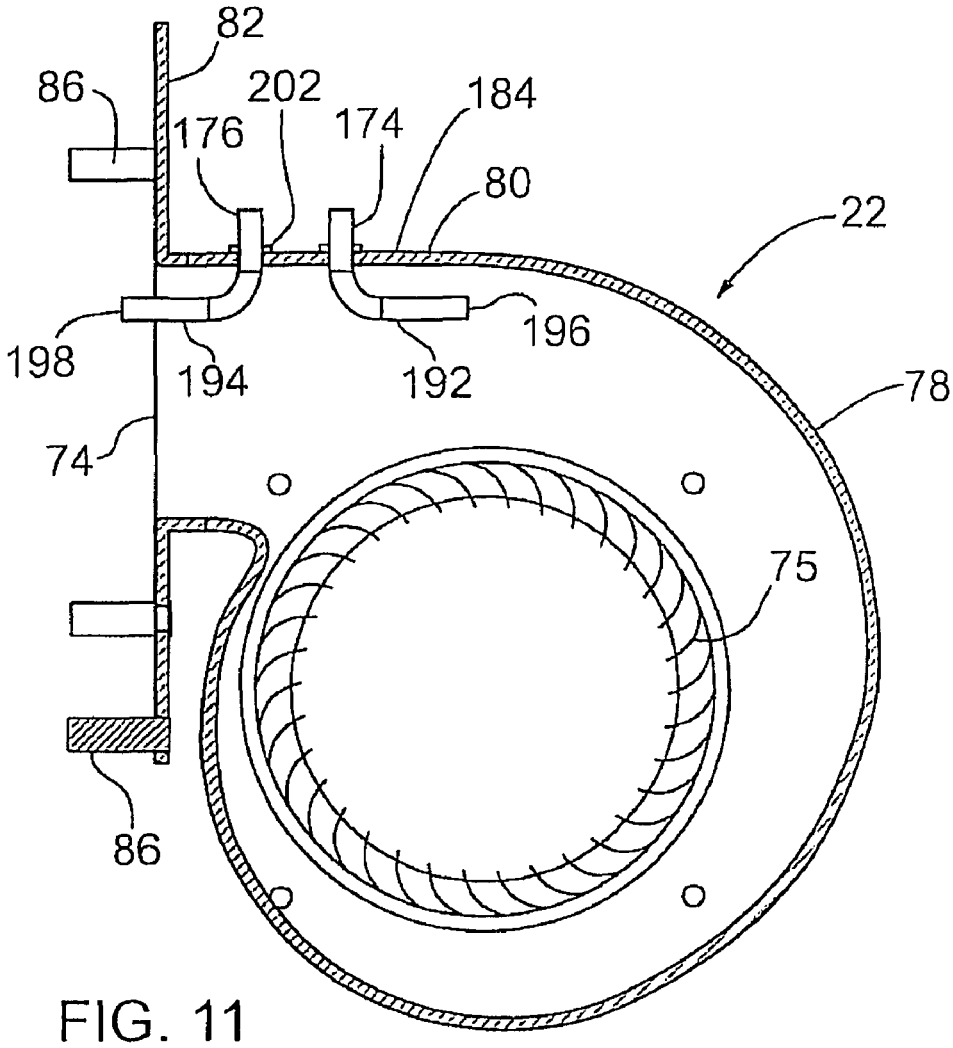
FIG. 11 is a cross-sectional view of the blower and its mounting flange, this view being taken along the line XI-XI of FIG. 10.

The pitot tubes are substantially L-shaped as can be seen clearly in FIG. 11. Each has an inner leg section 192, 194 and a further leg section which extends through the wall of the casing. The two leg sections are joined at a rounded corner which bends to an angle of 90° approximately. The inner leg sections are arranged within the outlet section 80 of the blower during use of the radiant tube heater and they extend in opposite directions to their respective pressure sensing ends 196, 198. The first pitot tube 174, which is closest to the fan wheel, is adapted to measure impact pressure by the blower while the second pitot tube 176 is adapted to measure static pressure. As indicated, the tubes are operatively connected to the differential pressure switches which act to control the operation of the burner assembly. It will be understood that the pivot tube assembly and, in particular the pitot tubes, are adapted to sense pressure changes and to provide details of these changes to the differential pressure switches.

As can be seen from FIG. 11, the inner leg section 194 of the second pitot tube extends through the air outlet or blower outlet 74 formed centrally in the mounting flange plate 82. By making the pitot 176 L-shaped and placing its pressure sensing end 198 in the illustrated position, a more accurate static pressure reading can be obtained by this pressure sensor. This is believed to be due to the fact that the pressure sensing end 198 is placed further from the blower fan 75 and thus the air flow in the vicinity of the end 198 is less turbulent than the air flow closer to the fan. The result of this pitot tube arrangement is better control of the gas valve unit by the pressure switches.

Figure 12:
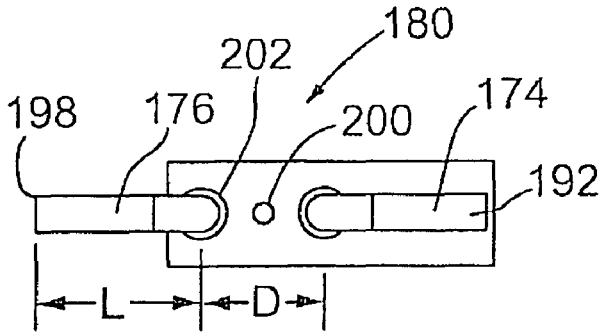
FIG. 12 is an inner side view of a pitot tube assembly, this view showing the side of its mounting plate which faces the blower housing wall.

Also shown in FIG. 12 is a fastener hole 200 through which the screw 190 extends to attach the mounting plate. Welding or brazing at 202 can be used to sealingly connect each pitot tube to the mounting plate. In one exemplary embodiment of the pitot tube assembly, the length of the mounting plate was 2.4 inches and the length L of the inner leg section 194 measured from the axial center line of the outwardly projecting leg section is about 1.2 inch. The distance D between the two parallel center lines of the outwardly projecting legs of the pitot tubes is about 0.9 inch.

FIGS. 3 to 6 and 10 illustrate an exemplary feature of the burner assembly. In order to improve the distribution of the combustion air across the height and width of the air duct portion 62, there can be provided an air diverter in the form of a diverter ring 210 having a plurality of diverter blades 212 extending about its circumference. This ring can be made from a single metal plate which is preferably aluminized steel. It has a central circular hole at 214 through which a reduced cylindrical end section 216 of the burner head extends. Surrounding the central hole in the plate is an annular connecting section 218 of the plate, the blades extending outwardly from this connecting section. As shown, each blade has a first section 220, which extends in the same radial plane as the connecting section and a second sloping section 222. These blades can be made by a straightforward metal stamping process.

Figure 16:
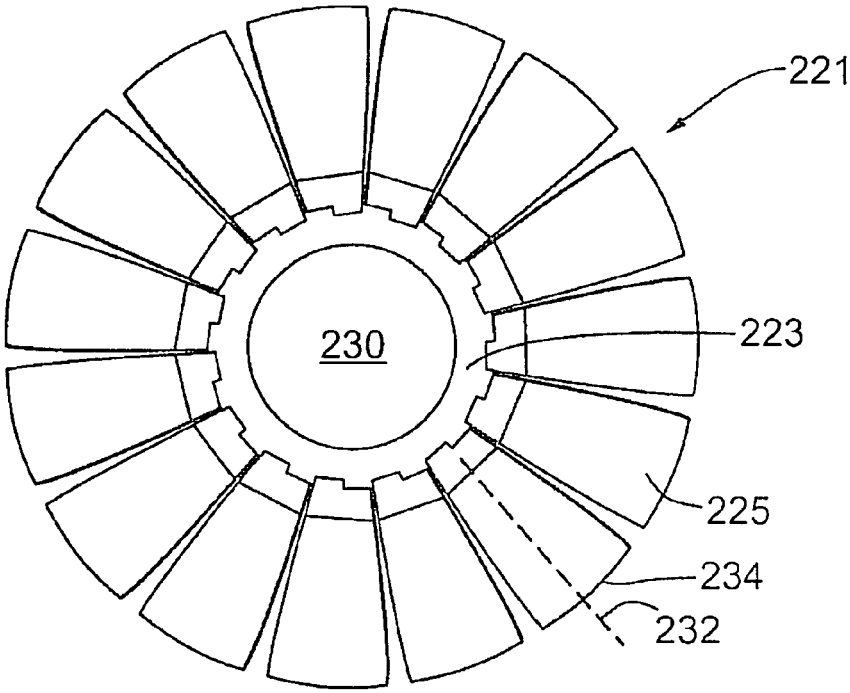
FIG. 16 is a side view of another form of air diverter ring.
Figure 17:
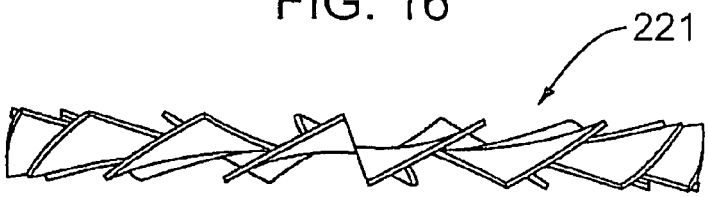
FIG. 17 is an edge view of the air diverter ring of FIG. 16.

It is also possible to construct a diverter ring 221 wherein the whole of each blade 225 extends at an angle to the radial plane as shown in FIGS. 16 and 17. In the diverter ring 221, there is a circular center hole 230, which in one embodiment has a diameter of 1.03 inch and this hole is surrounded by an annular connecting section 223. The number of blades formed about this connecting section in the air diverter as shown is sixteen and each of this blades is twisted about its longitudinal axis indicated at 232 for one of the blades. Thus, the outer end or tip of each blade indicated at 234 slopes at a greater angle to the plane of the connecting section 223 as compared to an inner end section of the blade. Each of the blades is twisted a similar amount about its central longitudinal axis. A diverter ring of the type shown in FIGS. 16 and 17 is shown mounted on the burner cap assembly in FIGS. 5 and 6.

Neither the ring 210 nor the ring 221 rotates, each being fixedly held in position by means of a screw (not shown) that extends through the connecting section 218 or 223 and into the rearwardly facing shoulder formed on the inlet portion 96'. The slope of the angular portion of each blade can vary and typically is 30, 45 or 60 degrees relative to the plane of the flat first section 220 in the case of the blade 212. In the case of each twisted blade 225, the slope of the tip of the blade can vary and in an exemplary form of this diverter ring ranges between 30 and 60 degrees relative to the plane of the connecting section 223. The best angle for a particular burner application can be determined by trial and error. These diverter rings are for low firing rate burners, typically in the 60,000 to 90,000 BTU range. Aluminized steel for the diverter is preferred as it can withstand the heat given off by the burner and it will not corrode in this environment.

The use of a diverter ring as described above has a number of advantages in this type of radiant tube heater. One significant advantage is that the blades of the ring not only impart a swirling motion to the combustion air which helps to improve combustion and the efficiency of the heater but also they direct a portion of the combustion air from the blower through the ports 104 of the inlet portion of the mixing cup assembly, thus providing more primary air for mixing in the upstream inlet portion than can be provided simply by the use of the above described restricting plate. Also, by providing more primary air through these ports, there is in effect a larger distance for this primary air to mix with the combustible gas. It will be seen from FIG. 5 for example that the axial distance from the ports 104 to the ceramic tile 46 is substantially greater than the distance from the inlet holes 116 to the ceramic tile. There is greater mixing or interaction between the combustible gas and the primary air with the use of the diverter ring or, in other words, the collision between the gas molecules and the air molecules is much greater.

As indicated, the diverter ring and its blades create a swirling motion in the combustion air coming from the blower and this swirling action is particularly noticeable and effective in the region between the wide outlet portion of the burner cup and the inner wall of the air duct portion of the tubular arrangement forming the burner tube. This swirling motion itself increases the burning efficiency of the tube heater. With the use of the diverter ring, one can obtain a larger flame length down the burner tube resulting in better heat distribution. If a diverter ring such as the illustrated ring is not used in the described radiant tube heater, there can be a problem of delayed ignition which can occasionally result in a small explosion-like sound during start up of the tube heater. By using the described diverter ring, on time ignition can be achieved and the aforementioned sound created by delayed ignition can be avoided. Although the cause of the aforementioned delayed ignition when one is not using a diverter ring is not known with certainty, it is believed that the delayed ignition is caused by eddies formed by the incoming combustion air creating a type of dead zone.

By controlling and properly setting the angle of the blades of the diverter ring, the user or operator can control the mixing process and the efficiency of the radiant tube heater. By having less angle to the sloping portions of the blades or at the blade tips in the case of the second embodiment of the air diverter, one can divert more air through the ports 104. The objective in setting the angle of the blades is to have a balance between the amount of primary air entering through the ports 104 and the amount of primary air entering through the series of air inlet holes 116 formed at the upstream end of the outlet portion.

Figure 9:
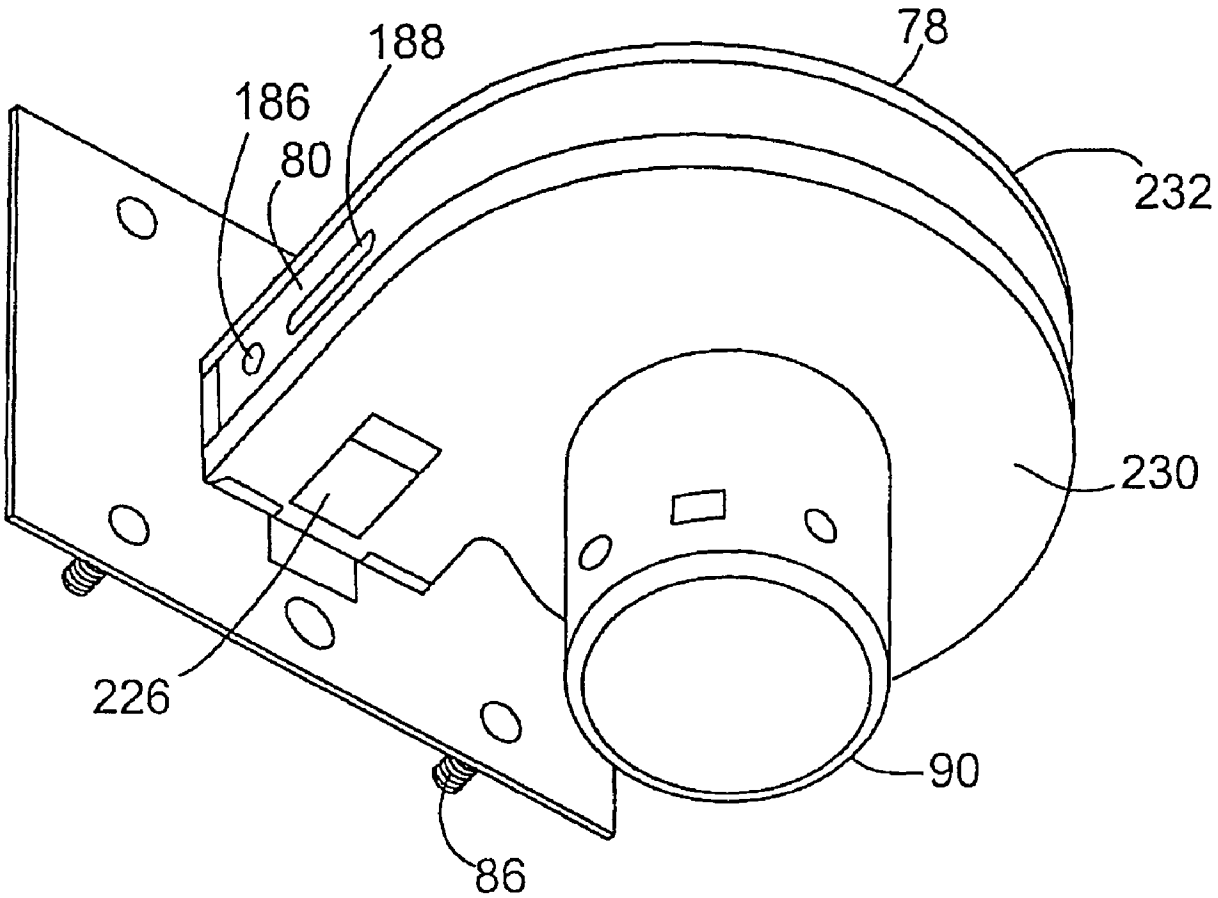
FIG. 9 is a perspective view of the blower and its mounting flange, this view being taken from the motor side of the blower and showing the upstream side of the flange.

FIG. 9 illustrates a rectangular side opening 226 formed in the outlet section of the blower casing. It will be understood that the gas line that extends from the gas valve unit to the gas nozzle extends through this opening which is sealed off around the gas line. The blower has two opposing side walls 230, 232 extending perpendicular to the axis of rotation of the fan 75 of the blower. The opening 226 is formed in the side wall 230 adjacent the downstream end of the blower outlet section 80.

While the present invention has been illustrated and described as embodied in certain exemplary embodiments, it is to be understood that the present invention is not limited to the details shown herein, since it will be understood that various omissions, modifications, substitutions and changes in the form and details of the disclosed heating assembly and burner assembly can be made by those skilled in the art without departing in any way from the spirit and scope of the present invention. For example, those with ordinary skill in the art will readily adapt the present disclosure for various other applications without departing from the spirit and scope of the present invention.

The invention claimed is:

1. A heating assembly for a radiant tube heater having a radiant heating burner tube with an upstream end, said heating assembly comprising:

a mixing cup assembly adapted for mounting centrally within said burner tube and adapted for mixing primary air and combustible gas and for delivering the resulting mixture into the burner tube, said cup assembly having an inlet portion and a substantially cylindrical outlet portion located at a downstream end of the inlet portion and having a diameter greater than a corresponding dimension of said inlet portion, a series of air inlet holes being formed in an upstream end wall of said outlet portion for introduction of said primary air directly into said outlet portion, ports being formed in and around a peripheral surface of said inlet portion for introduction of said primary air into said inlet portion for an initial mixing with said combustible gas;

a gas line for introducing said combustion gas into said mixing cup assembly, said gas line having one end connected to said mixing cup assembly and an opposite upstream end;

a gas valve system including a gas valve unit having an outlet connected to said upstream end of the gas line, said gas valve system regulating flow of said combustible gas to said mixing cup assembly during use of the heating assembly;

a blower for providing air for combustion to the radiant tube heater, said blower including a blower outlet section adapted for connection to said upstream end of the burner tube;

an annular airflow restricting plate mounted on said mixing cup assembly and extending circumferentially around said mixing cup assembly, said restricting plate having an array of holes distributed over the plate and being arranged at a downstream end of said inlet portion and adjacent to said upstream end wall of the outlet portion; and an air diverter mounted at or near an upstream end of said mixing cup assembly, said air diverter having a plurality of diverter blades distributed circumferentially around said upstream end of the mixing cup assembly at least a section of each diverter blade sloping at an angle ranging between 30 and 60 degrees relative to a radial plane extending perpendicular to an axial centerline of the outlet portion, wherein during use of said heating assembly, said restricting plate substantially spans an annular passage for said secondary air formed between said outlet portion and the burner tube, said diverter blades direct a portion of the combustion air from said blower through said ports to provide primary air and impart a swirling motion to the combustion air from said blower, a further portion of the combustion air enters said outlet portion of the mixing cup assembly through said air inlet holes to provide a further amount of primary air for mixing with the combustible gas, and a remaining amount of the combustion air flows between said outlet portion and said burner tube to provide said secondary air for combustion.

2. A heating assembly according to claim 1 wherein said inlet portion has a cylindrical end section of reduced diameter forming an upstream facing shoulder and said air diverter is fixedly mounted on said end section adjacent said shoulder.

3. A heating assembly according to claim 1 wherein said air diverter is a ring member made from metal plate, said ring member having a planar, annular connecting section surrounding a central aperture, said blades extending radially outwardly from said connecting section.

4. A heating assembly according to claim 3 wherein said air diverter is formed by stamping said metal plate, which is made of aluminized steel.

5. A heating assembly according to claim 1 wherein said mixing cup assembly includes a burner nozzle that extends into and is connected to said inlet portion, said one end of the gas line being connected to said nozzle, and further includes a perforated ceramic tile mounted in a downstream end section of the outlet portion, said resulting mixture of gas and primary air flowing through said ceramic tile during use of the tube heater.

6. A radiant tube heater apparatus comprising;

an elongate tubular arrangement having an air duct portion forming a passage for combustion air, including primary air and secondary air, and a radiant tube portion which is heated by and surrounds a laminar flame during use of the heater apparatus and which extends downstream of said air duct portion in relation to the flow of combustion air in said passage, said air duct portion having an inlet at one end for receiving said combustion air;

a blower for providing combustion air to said inlet of said air duct portion, said blower including a blower casing with an outlet section adapted for connection to said air duct portion at said inlet;

a burner assembly mountable in said air duct portion, said burner assembly including a mixing cup assembly for mixing combustible gas and said primary air and for delivering the resulting mixture to said radiant tube portion for burning, said cup assembly having an inlet portion and a substantially cylindrical outlet portion located at a downstream end of the inlet portion and having a diameter greater than a corresponding dimension of said inlet portion, a series of air inlet holes being formed around an annular upstream end wall of said outlet portion, said inlet portion having ports formed in a peripheral wall thereof;

gas line means for conducting said combustible gas to said inlet portion of the burner assembly;

a metal air diverter mountable within said air duct portion adjacent an upstream end of said inlet portion of the cup assembly, said air diverter having a plurality of blades distributed about a perimeter thereof; and an airflow restricting device mounted on and extending around said cup assembly, said restricting device being an annular metal plate having an array of holed formed therein and distributed about its circumference and being adapted to restrict flow of secondary air between said outlet portion and an inner wall of said air duct portion during use of the tube heater apparatus, said metal place substantially spanning an annular passage formed between said outlet portion and said inner wall of said air duct portion, wherein, during use of said tube heater apparatus, said air diverter directs a portion of the combustion air through said ports to provide said primary air for initial mixing with said combustible gas, a further portion of said combustion air enters said outlet portion through said air Inlet holes to provide an additional amount of said primary air for mixing with the combustible gas, and a remaining amount of the combustion air flows between said outlet portion and a surrounding inner wall of the air duct portion to provide said secondary air for combustion.

7. A radiant tube heater according to claim 6 wherein said air diverter is a separate ring member having a plurality of diverter blades distributed about its circumference, said ring member being mountable on said inlet portion of the mixing cup assembly.

8. A radiant tube heater according to claim 7 wherein said restricting device is mounted at a downstream end of said inlet portion adjacent to said upstream end wall of said outlet portion.

9. A radiant tube heater according to claim 7 wherein at least a section of each said diverter blade slopes at an angle ranging between 30 and 60 degrees relative to a radial plane extending perpendicular to an axial centerline of the outlet portion.

10. A burner assembly for a radiant tube heater having an air duct portion forming a passage for combustion air from a blower and a radiant tube portion extending downstream from the air duct portion in relation to the flow of said combustion air, said burner assembly comprising:

a mixing cup device for mixing combustible gas and a portion of said combustion air and for delivering the resulting mixture to said radiant tube portion for burning, said cup device being adapted for mounting in said air duct portion, said cup device having an inlet portion and a larger substantially cylindrical outlet portion having a diameter greater than a corresponding dimension of said inlet portion, air inlet holes being formed in an upstream end wall of the outlet portion, air ports being formed in a circumferentially extending, peripheral wall of said inlet portion and located upstream of said outlet portion, a gas nozzle provided at said inlet portion and connectible to a combustible gas supply line;

an air diverter adapted for mounting adjacent an upstream end of said inlet portion, said air diverter having a plurality of blades distributed about a perimeter thereof, and an annular airflow restricting late mounted on the inlet portion of said mixing cup device and extending circumferentially around said mixing cup device, said restricting plate having an array of holes formed therein, wherein during use of the burner assembly, said restricting plate substantially spans an annular passage for secondary combustion air formed between the outlet portion and said air duct portion and wherein, during use of the burner assembly, said air diverter directs a portion of the combustion air through said ports to provide primary air for initial mixing with said combustible gas and impart a swirling motion to the combustion air while allowing a second portion of the combustion air to flow through said inlet holes to provide additional primary air for mixing with said combustible gas.

11. A burner assembly according to claim 10 wherein said air diverter is a ring member made from a stamped metal plate, said ring member having a planar, annular connecting section, said blades extending radially outwardly from said connecting section.

12. A burner assembly according to claim 10 wherein at least a portion of each blade slopes at an angle ranging between 30 to 60 degrees relative to a radial plane extending perpendicular to an axial centerline of the outlet portion.

13. A burner assembly according to claim 10 wherein said gas nozzle is detachably connected by threads to said inlet portion and said mixing cup device includes a perforated ceramic plate mounted in a downstream end section of the outlet portion, said resulting mixture of gas and primary air flowing through said ceramic tile during use of the burner assembly.

14. A burner assembly according to claim 13 wherein said air diverter is a ring member made from a stamped metal plate, said ring member having a planar, annular connecting section, said blades extending radially outwardly from said connecting section.

15. A burner assembly according to claim 14 wherein said inlet portion is cylindrical and includes a downstream main section and an integral upstream end section of reduced diameter relative to the diameter of said main section and said ring member is fixedly mounted on said upstream end section.

* * * * *